US005263212A

United States Patent [19]

Garcia

[11] Patent Number: 5,263,212

[45] Date of Patent: Nov. 23, 1993

[54] WRINKLE FREE BEDSHEET

[76] Inventor: Juan C. Garcia, 12 Birch St., Central Islip, N.Y. 11722

[21] Appl. No.: 892,939

[22] Filed: Jun. 3, 1992

[51] Int. Cl.[5] ..... A47G 9/02

[52] U.S. Cl. ..... 5/496; 5/498

[58] Field of Search ..... 5/494–499

[56] References Cited

U.S. PATENT DOCUMENTS

| | | | |
|---|---|---|---|
| 1,833,298 | 11/1931 | Oakey | 5/498 |
| 2,284,778 | 6/1942 | Treiber | 5/498 |
| 2,440,891 | 5/1948 | Bockhold | 5/496 |
| 2,907,055 | 10/1959 | Berman | 5/496 |
| 3,134,110 | 5/1964 | Gamichon | 5/498 |
| 5,027,456 | 7/1991 | Wadsworth | 5/494 |

FOREIGN PATENT DOCUMENTS

| | | | |
|---|---|---|---|
| 1445600 | 6/1966 | France | 5/496 |

*Primary Examiner*—Peter M. Cuomo
*Assistant Examiner*—Flemming Saether
*Attorney, Agent, or Firm*—Michael I. Kroll

[57] ABSTRACT

An improved bed covering is provided for a mattress on a bedstead, which consists of an apparatus for protecting the mattress and a mechanism for retaining the protecting apparatus to the mattress on the bedstead in a wrinkle free condition. A person resting on the protecting apparatus will be more comfortable.

6 Claims, 2 Drawing Sheets

WRINKLE FREE BEDSHEET

BACKGROUND OF THE INVENTION

1. Field of the Invention

The instant invention relates generally to bedding products and more specifically it relates to an improved bed covering for a mattress on a bedstead.

2. Description of the Prior Art

One of the major problems with bedding products currently on the market is that although a bottom sheet is specially designed to fit a mattress, a top sheet must still be folded at the corners and tucked in to secure it in place and keep it from pulling out. This method of folding and tucking the bottom corner of the top sheet, however, does not always work very well. It tends to pull out rather easily, especially when a sleeper is restless and tosses and turns in a bed. The result is that every time a bed is made the top sheet must be refolded and secured. Not only is this time-consuming and annoying, but the looseness of the sheet can also interfere with a comfortable night's rest when it pulls out and get tangled up with the sleeper and other bedding.

Numerous bedding products have been provided in prior art that are adapted to be coverings, such as sheets and blankets, ordinarily used on beds. While these units may be suitable for the particular purpose to which they address, they would not be as suitable for the purposes of the present invention as heretofore described.

SUMMARY OF THE INVENTION

A primary object of the present invention is to provide an improved bed covering that will overcome the shortcomings of the prior art devices.

Another object is to provide an improved bed covering that can be produced in various sizes and styles to fit most standard beds, so that bed making will be more convenient to accomplish.

An additional object is to provide an improved bed covering that makes it possible to removably fasten a cover sheet to a harness attached to fit under a mattress and a bedstead, so that the cover sheet can be taken off and repositioned to the mattress when needed.

A further object is to provide an improved bed covering that is simple and easy to use.

A still further object is to provide an improved bed covering that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
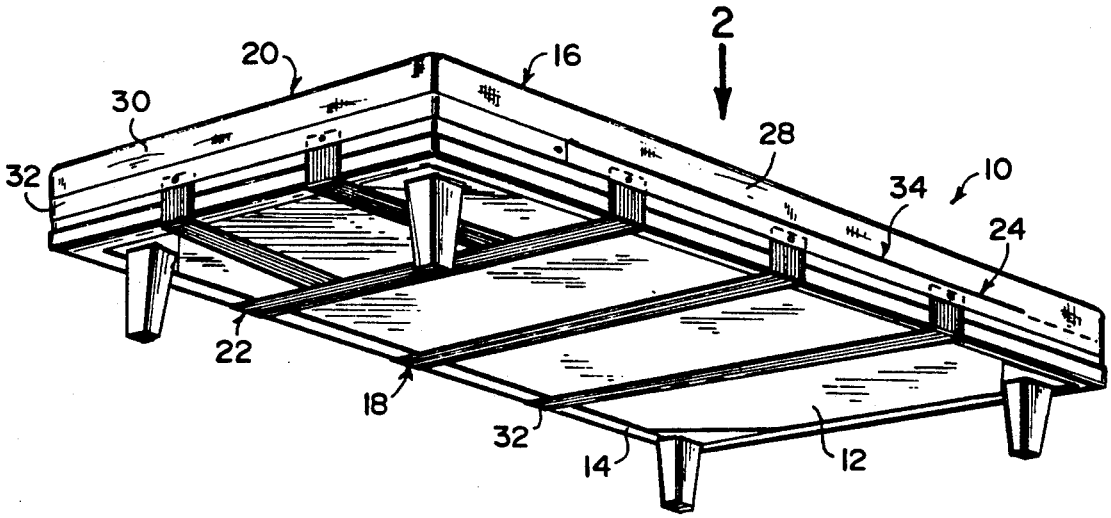
FIG. 1 is a bottom perspective view of the instant invention installed on a bed.
Figure 2:
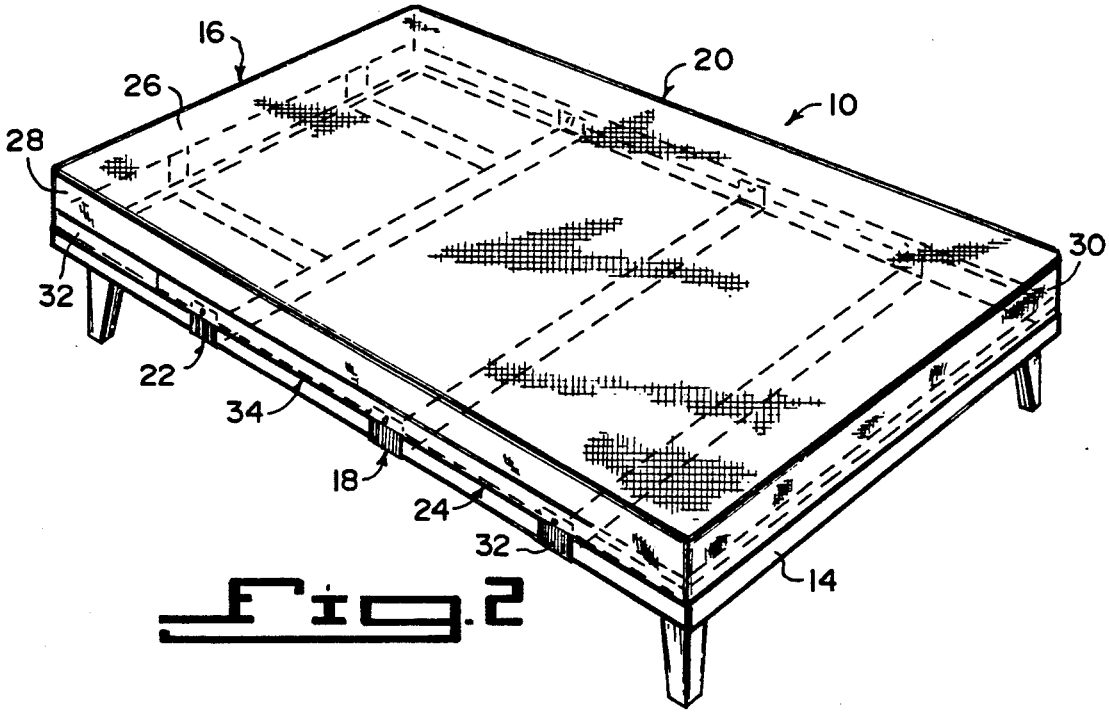
FIG. 2 is a top perspective view taken in direction of arrow 2 in FIG. 1.
Figure 3:
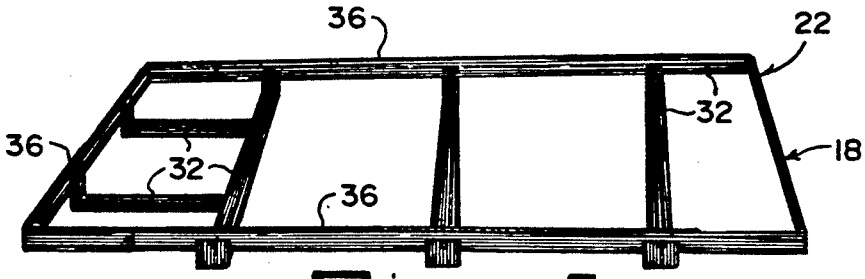
FIG. 3 is a top perspective view of just the harness.
Figure 4:
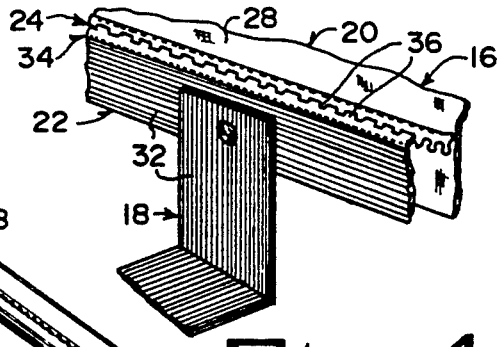
FIG. 4 is an enlarged perspective view showing a portion of the zipper between the harness and cover sheet.
Figure 5:
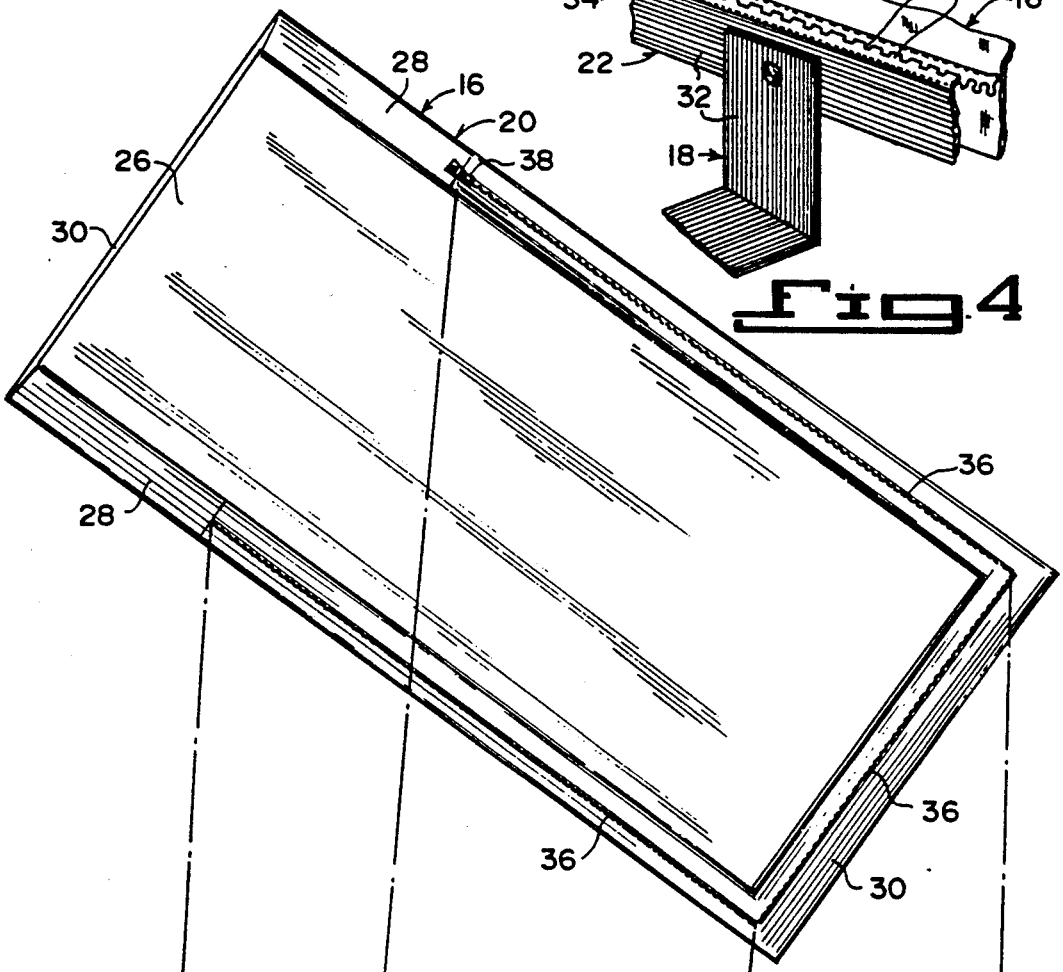
FIG. 5 is an exploded perspective view of the instant invention showing the cover sheet removed from the harness.
Figure 5:
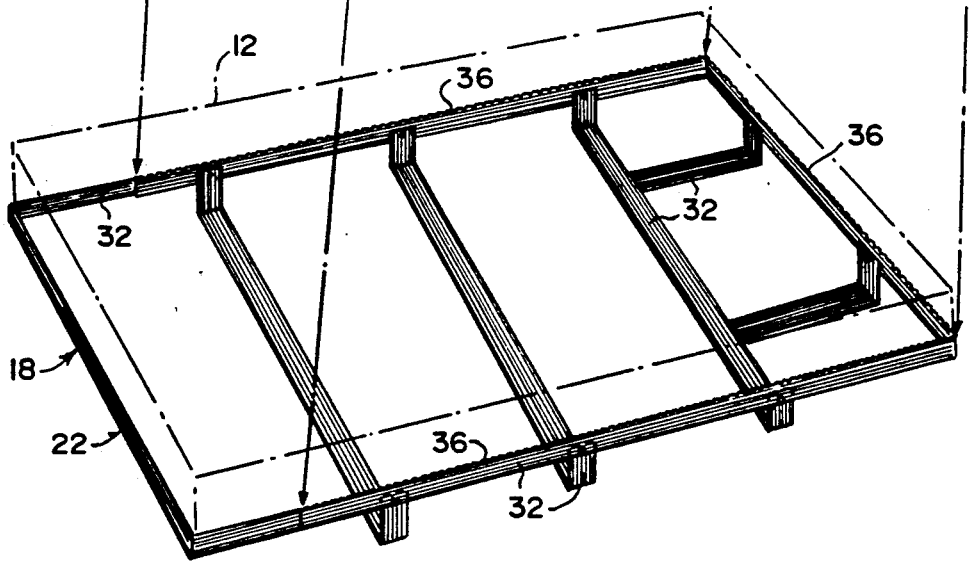

Turning now descriptively to the drawings, in which similar reference characters denote similar elements throughout the several views, the Figures illustrate an improved bed covering 10 for a mattress 12 on a bedstead 14 which consists of an apparatus 16 for protecting the mattress and a mechanism 18 for retaining the protecting apparatus 16 to the mattress 12, on the bedstead 14 in a wrinkle free condition. A person resting on the protecting apparatus 16 will be more comfortable.

The protecting apparatus 16 is a cover sheet 20 to fit onto the mattress 12. The retaining mechanism 18 includes a harness 22 to engage with the mattress 12 and the bedstead 14. A structure 24 is for removably fastening the cover sheet 20 to the harness 22, so that the cover sheet 20 can be taken off and repositioned to the mattress 12 when needed.

The cover sheet 20 contains a thin flat flexible top member 26 sized to fit onto the top of the mattress 12. A pair of thin flat flexible side members 28 are provided with each extending downwardly from one side of the top member 26 and sized to fit against one side of the mattress 12. A pair of thin flat flexible end members 30 are also provided with each extending downwardly from one end of the top member 26 and sized to fit against one end of the mattress 12.

The top member 26, the side members 28 and the end members 30 are integral and fabricated out of a piece of fabric material. The harness 22 consists of a plurality of elastic webbing straps 32 fitted and joined together to form a frame, to fit onto the bottom of the mattress 12 and the sides and ends of the mattress 12 and the bedstead 14.

The removably fastening structure 24 is an elongated zipper 34 which includes parallel rows of teeth 36 on adjacent edges of the cover sheet 20 and the harness 22. A sliding tab 38 is for interlocking the teeth 36 together.

The cover sheet 20, the harness 22 and the elongated zipper 34 are produced in various sizes and styles to fit most standard beds, typically but not limited to twin, full, queen and king size beds. The cover sheet 20 and the harness 22 are produced in different color and print configuration, so as to be used in conjunction with other matching bed sheets.

The improved bed covering 10 offers a new convenience in bedding products that would be appealing to many people and could be designed both for consumer and commercial/institutional uses and markets. It fulfills the need for a new type of bed sheet that is easier to install and remove for convenience in making beds and keeping bedclothes smoothly in place while sleeping.

The unique features of the improved bed covering 10 are its easy to use application, being suitable for any type of bed, such as in commercial/institutional facilities as well as for consumers and its affordable price. In addition, the same concept could also be used to produce fitted quilts and other bedding items that normally rest on top of the sheets or are tucked in around the mattress 12. The advantages would be the same. The blanket or quilt could zip to the harness 22 around the bottom end edge of the mattress 12 to keep them from slipping off or out of place during the night. It would increase comfort for the sleeping person and convenience by saving on time and labor in bed making activities.

The improved bed covering 10 could be produced easily, utilizing conventional and readily available materials, processes and processing equipment. No new production technology would be required. The invention could be produced both as part of a matched set of sheets in a designer series of special patterns for a luxury market and in economical styles to produce an inexpensive product line. Since coordinated bedding is a popular product at the present time, the same principle of the invention applied to this product should tend to enhance its original concept, being more practical and advantageous than standard bed sheets.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved bed covering for a mattress on a bed frame which comprises:

a) a bed wherein a harness assembly has a perimeter elastic webbing strap extending completely around the perimeter of the mattress and a strap lattace disposed within said perimeter elastic webbing strap, said lattace containing a plurality of elastic webbing straps each of said plurality of elastic webbing strap of said lattace having an end which is joined to said perimeter elastic webbing strap;

b) a homogeneous coversheet fit onto the mattress and removably secured to said perimeter elastic webbing strap by a zipper;

c) means for retaining said homogeneous coversheet to the mattress from below said bed frame and said mattress in a wrinkle free condition, so that a person resting on said cover sheet will be more comfortable, said retaining means includes said harness assembly which engages with said coversheet from below both the bed frame and the mattress without the need for any support members.

2. An improved bed covering as recited in claim 1, wherein said cover sheet includes:

a) a thin flat flexible top member sized to fit onto the top of the mattress;

b) a pair of thin flat flexible side members, each extending downwardly from one side of said top member and sized to fit against one side of the mattress; and c) a pair of thin flat flexible end members, each extending downwardly from one end of said top member and sized to fit against one end of the mattress.

3. An improved bed covering as recited in claim 2, wherein said top member, said side members and said end members are integral and fabricated out of a piece of fabric material.

4. An improved bed covering as recited in claim 1, wherein said zipper includes:

a) parallel rows of teeth on adjacent edges of said cover sheet and said harness; and b) a sliding tab for interlocking said teeth together.

5. An improved bed covering as recited in claim 4, wherein said cover sheet, said harness and said elongated zipper are produced in various sizes and styles to fit most standard beds, typically but not limited to twin, full, queen and king size beds.

6. An improved bed covering as recited in claim 5, wherein said cover sheet and said harness are produced in different color and print configurations, so as to be used in conjunction with other matching bed sheets.

* * * * *